US006612138B2

(12) United States Patent
Ryu et al.

(10) Patent No.: US 6,612,138 B2
(45) Date of Patent: Sep. 2, 2003

(54) DRUM WASHING MACHINE

(75) Inventors: Doo-young Ryu, Suwon (KR); Koan-seog Namkung, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/158,142

(22) Filed: May 31, 2002

(65) Prior Publication Data

US 2003/0121294 A1 Jul. 3, 2003

(30) Foreign Application Priority Data

Dec. 28, 2001 (KR) ..... 2001-0086900

(51) Int. Cl.[7] ..... D06F 9/00
(52) U.S. Cl. ..... 68/58
(58) Field of Search ..... 68/58

(56) References Cited

U.S. PATENT DOCUMENTS 2,937,516 A * 5/1960 Czaika ..... 68/58

FOREIGN PATENT DOCUMENTS

| | | | |
|---|---|---|---|
| DE | 1155083 | * 10/1963 | ..... 68/58 |
| DE | 3830500 | * 3/1990 | ..... 68/58 |
| KR | 1998-67224 | 12/1998 | |

* cited by examiner

*Primary Examiner*—Randy Gulakowski
(74) *Attorney, Agent, or Firm*—Staas & Halsey L.L.P.

(57) ABSTRACT

A drum washing machine with a washing water circulation unit adapted to completely dissolve detergent supplied together with washing water and to enhance washing efficiency. During a washing operation, the washing water contained in a fixed drum is raised or drawn to a center portion of a rear panel of a rotatable drum by turning force of the rotatable drum and then sprayed into the rotatable drum through a nozzle. The circulated washing water accelerates the dissolution of the detergent, and the sprayed washing water directly impinges on laundry, thereby shortening the amount of time required to wet the laundry with the washing water. Therefore, the washing efficiency of the drum washing machine can be remarkably enhanced using only a small quantity of the washing water.

42 Claims, 5 Drawing Sheets

DRUM WASHING MACHINE

CROSS-REFERENCE TO RELATED APPLICATIONS

This application claims the benefit of Korean Application No. 2001-86900, filed Dec. 28, 2002, in the Korean Industrial Property Office, the disclosure of which is incorporated herein by reference.

BACKGROUND OF THE INVENTION

1. Field of the Invention

The present invention relates to a drum washing machine, and more particularly, to a drum washing machine having a washing water circulation unit improving washing efficiency by spraying washing water contained in a fixed drum to a central portion of a rotatable drum.

2. Description of the Related Art

In general, a drum type washing machine is an appliance intended to carry out a washing operation by falling washing water during rotation of a rotatable drum. The drum washing machine includes a hexahedral housing, a fixed drum suspended in the hexahedral housing containing the washing water, the rotatable drum disposed in the fixed drum to rotate in forward and reverse directions, and a shock absorbing member supporting the fixed drum within the hexahedral housing.

In the drum washing machine, washing, rinsing and dehydrating operations are automatically carried out in accordance with a previously inputted program while the rotatable drum rotates. The washing operation carried out by the drum washing machine can be classified into one of a stain washing operation for stained laundry, a standard washing operation, and a wool washing operation for wool laundry according to types of laundry. However, the conventional drum washing machine is limited in washing efficiency because the washing and rinsing operations are achieved only by falling washing water during rotation of the rotatable drum.

To overcome the above problems, the applicant filed a Korean Utility Model Application No. 1997-11762, which has been published in Korean Laid-open No. 1998-67224, describing a washing water circulation unit spraying washing water on a rotatable drum by forcibly pumping the washing water contained in a fixed drum.

As shown in FIG. 1, a washing water circulation unit in a drum washing machine disclosed in the published specification of the above Korean Utility Model Laid-open No. 1998-67224 includes spray nozzles 3 spraying the washing water collected in a bottom of a tub or fixed drum 2 and pumped upward by a drainage pump 1, a first solenoid valve 4 disposed adjacent to the spray nozzles 3 and designed to be closed during a drainage operation and to be opened during a washing operation, a water circulation hose 6 connected at one end to the spray nozzles 3 and connected at the other end to a T-shaped connector 7 coupled between the drainage pump 1 and the drainage hose 5, and a second solenoid valve 8 disposed at an inlet of the drainage hose 5 and designed to be closed during the washing operation.

The spray nozzles 3 are disposed above an upper surface of the tub 2 in order to spray the washing water through a plurality of holes 9*a* formed at the wall of a rotatable drum 9. The second solenoid valve 8 prevents the washing water pumped by the drainage pump 1 from being drained through the drainage hose 5 during the washing operation. A reference numeral 13 denotes a door unit.

Accordingly, when the drainage pump 1 is activated while the washing operation is carried out by rotation of the rotatable drum 9, the washing water in the tub 2 is pumped to the upper surface of the tub 2 and then sprayed downward therefrom.

That is, the washing water pumped by the drainage pump 1 is guided to the spray nozzles 3 through the water circulation hose 6 and then sprayed into the rotatable drum 9 through holes 9*a*, thereby improving washing efficiency and solubility of detergent.

However, since the washing water sprayed through the spray nozzles 3 first impinges against an outer wall of the rotatable drum 9, only a small amount of the sprayed washing water can be sprayed into the rotatable drum 9 through the holes 9*a* and thus a large amount of the water flows downward along the outer wall of the rotatable drum 9 and returns to the tub 2.

Therefore, although the solubility of the detergent may be improved by circulation of the washing water, there is a limited improvement in the washing efficiency by the sprayed washing water. In addition, since the pump 1 must be operated even during the washing operation, power consumption is increased.

SUMMARY OF THE INVENTION

Accordingly, the present invention has been made to overcome the above and other problems of the related art, and an object of the present invention is to provide a drum washing machine with an improved washing water circulation unit which is adapted to directly spray washing water contained in a fixed drum into an inside of a rotatable drum during a washing operation so as to enhance washing efficiency and solubility of detergent.

It is another object of the present invention to provide a drum washing machine which is adapted to draw washing water contained in a fixed drum by a turning force of a rotatable drum and to spray the washing water into the rotatable drum.

Additional objects and advantages of the invention will be set forth in part in the description which follows and, in part, will be obvious from the description, or may be learned by practice of the invention.

In order to achieve the above and other objects, the present invention provides a drum washing machine including a housing, a fixed drum disposed in the housing and containing washing water, a rotatable drum rotatably disposed in the fixed drum, and a circulation unit supplying the washing water contained in the fixed drum to an inside of the rotatable drum, the circulation unit including a drawing unit drawing the washing water upwardly toward a central portion of a rear panel of the rotatable drum by a turning force of the rotatable drum, and a spray unit spraying the washing water into the inside of the rotatable drum, the spray unit disposed at the rear panel of the rotatable drum.

The drawing unit is disposed at the rear panel of the rotatable drum and is provided with a curved water-guiding duct connected at one end with the spraying unit, then extended to a periphery of the rear panel therefrom, and connected at the other end with the fixed drum.

The curved water-guiding duct unit includes first water-guiding ducts drawing the washing water during a forward rotation of the rotatable drum, and second water-guiding ducts drawing the washing water during a reverse rotation of the rotatable drum.

The first water-guiding ducts form a first pair symmetrical to each other and around the spraying unit, and the second water-guiding ducts form a second pair symmetrical to each other and around the spraying unit.

The spraying unit is located at the center portion of the rear panel of the rotatable drum and is provided with a nozzle which is formed with a plurality of holes to allow the washing water drawn by the drawing unit to be sprayed therethrough.

The washing water introduced through the first and second water-guiding ducts is sprayed through the holes of the spray unit, and an interior space of the spray unit is divided into a plurality of subspaces using a partition so as to prevent the first and second water-guiding ducts from communicating with each other.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
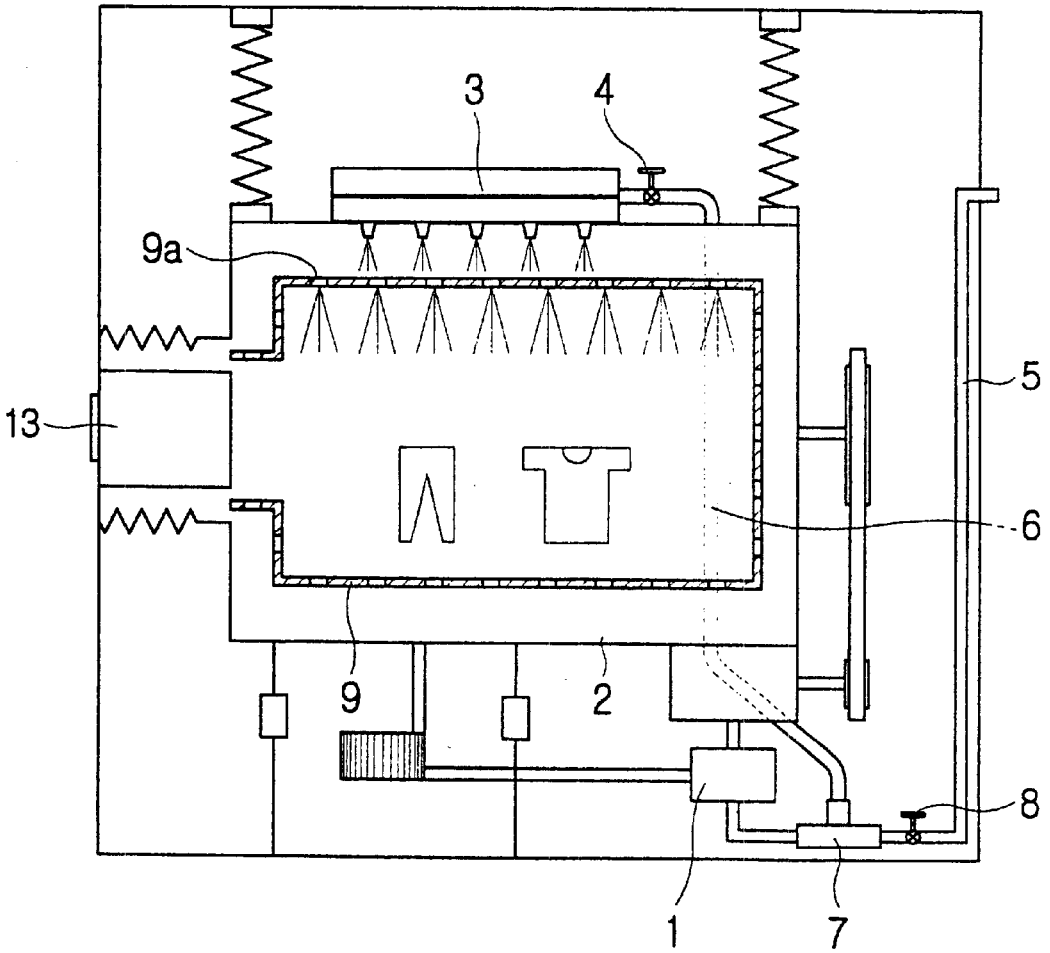
FIG. 1 (PRIOR ART)
FIG. 1 is a cross-sectional view showing a washing water circulating unit in a conventional drum washing machine.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
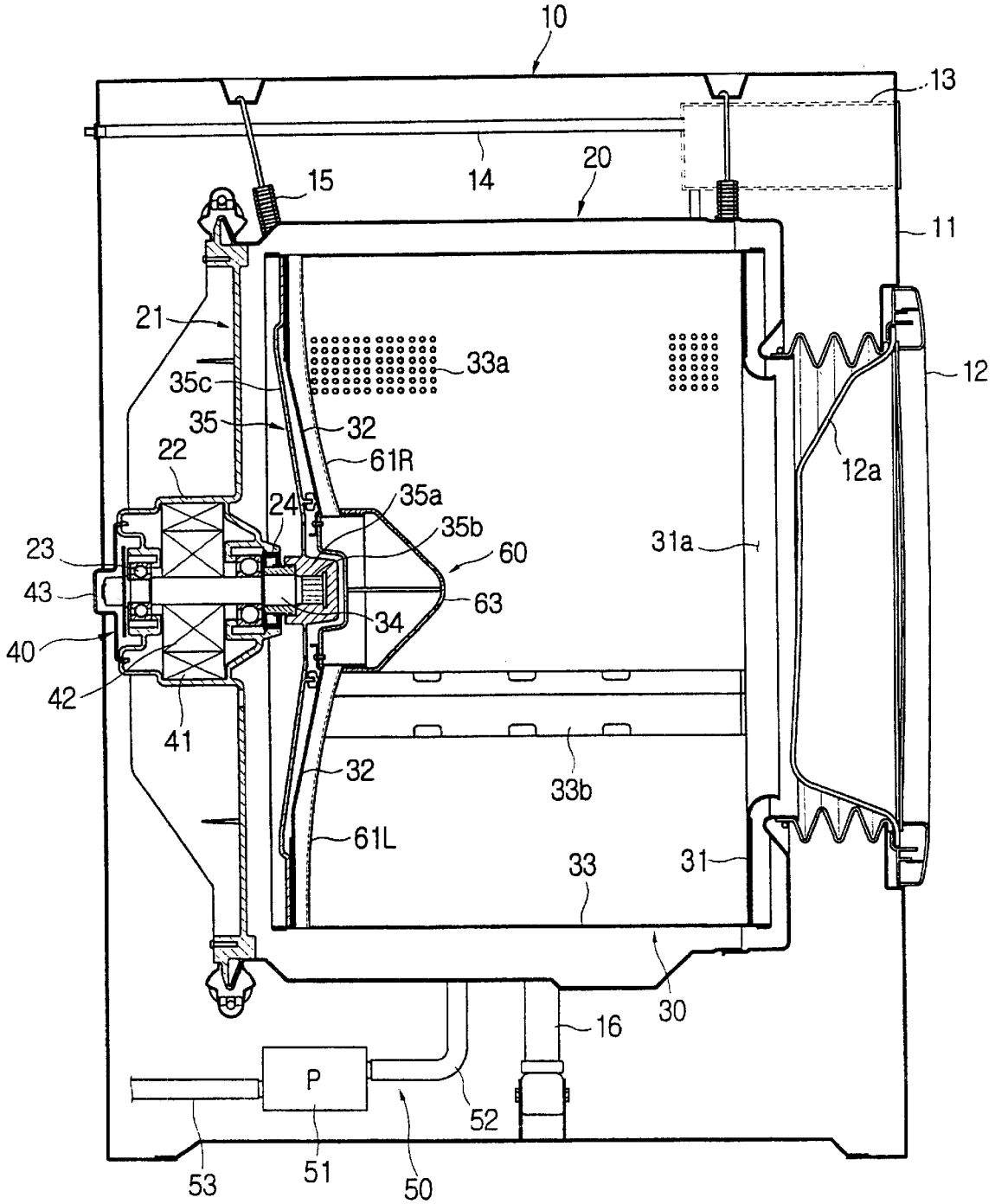
FIG. 2 is a cross-sectional view showing a drum washing machine according to an embodiment of the present invention.

Referring to FIG. 2, there is shown a drum washing machine according to an embodiment of the present invention. The drum washing machine includes a hexahedral housing 10 equipped with a door 12, a fixed drum 20 horizontally suspended in the housing 10 and adapted to contain washing water therein, a rotatable drum 30 installed in the fixed drum 20 to rotate in forward and reverse directions, a driving unit 40 driving the rotatable drum 30, a drainage unit 50 forcibly draining the washing water contained in the fixed drum 20 during a draining operation, and a washing water circulation unit 60 circulating the washing water contained in the fixed drum 20 into the rotatable drum 30 by a turning force of the rotatable drum 30 during washing and rinsing operations.

The housing 10 defines an outer shape of the drum washing machine. A fixed front panel 11 of the housing 10 is provided with a circular opening allowing laundry to be put into and taken out from the drum washing machine. The circular opening corresponds to a door 12 hingedly connected to the fixed panel 11. The door 12 is centrally provided with a transparent member 12*a* made of a glass plate so as to allow a user to view an interior of the rotatable drum 30. The housing 10 is provided at upper and inner positions with a detergent container 13 through which the washing water introduced through a feeding hose 14 flows into the fixed drum 20.

The fixed drum 20 is a cylindrical drum horizontally suspended in the housing 10. In order to install the fixed drum 20 within the housing 10, a plurality of shock absorbing springs 15 and shock absorbing members 16 are disposed between the housing 10 and the fixed drum 20. In other words, the fixed drum 20 is suspended at an upper portion from a top plate of the housing 10 using the shock absorbing springs 15 and is supported at a lower portion on a bottom plate of the housing 10 using the shock absorbing members 16 disposed therebetween. Furthermore, a fixed rear panel 21 of the fixed drum 20 is integrally provided at a center position with a bearing housing 22 in which bearings 23 and an oil seal 24 are fitted to rotatably support a rotating shaft 34 as described hereinafter and to prevent water leakage.

The rotatable drum 30 is concentrically rotatably disposed in the fixed drum 20 and includes a rotatable front panel 31 formed with an input opening 31*a* to allow the laundry to be put in and taken out from the rotatable drum 30, a rotatable rear panel 32 with the rotating shaft 34 mounted thereon, and a cylindrical side panel 33 adapted to connect the rotatable front panel 31 and the rotatable rear panel 32 and having a plurality of drainage holes 33*a*. The cylindrical side panel 33 of the rotatable drum 30 is horizontally provided with lifters 33*b* which are circumferentially spaced apart from each other by 120 degree intervals, so that the laundry contained in the rotatable drum 30 is raised by the lifters 33*b* and falls down when the rotatable drum 30 is rotated.

The rotatable rear panel 32 of the rotatable drum 30 is attached with a shaft-flange 35 using mounting bolts so as to allow the rotating shaft 34 to be mounted thereon. The shaft-flange 35 includes a central coupling part 35*a* in which one end of the rotating shaft 34 is fixed, and an attaching part 35*c* radially branched from the central coupling part 35*a* and coupled to the rotatable drum 30 by the mounting bolts . The central coupling part 35*a* is centrally provided with a shaft-coupling hole 35*b* having an inner serrated portion corresponding to an outer serrated portion formed at the one end of the rotating shaft 34 so as to fixedly couple the rotating shaft 34 to the central coupling part 35*a*. That is, the rotating shaft 34 is fixed at the one end to a center portion of the rotatable rear panel 32 of the rotatable drum 30 with the shaft-flange 35 disposed therebetween and rotatably supported at the other end by the bearings 23 of the bearing housing 22 to be directly connected to the driving unit 40.

The driving unit 40 is externally mounted on the fixed rear panel 21 of the fixed drum 20 and includes a stator 41 fixedly fitted in the bearing housing 22, a rotor 42 inserted into the stator 41, the rotating shaft 34 rotatably supported by the bearings 23 inserted into the rotor 42, and a cover 43 attached to the housing 22 to cover the driving unit 40 and the housing 22. The rotor 42 rotates in the forward and reverse directions together with the rotating shaft 34 and the rotatable drum 30 during the washing and rinsing operations. A control unit of the drum washing machine is programmed such that the rotor 42 rotates in one of the forward and reverse direction by controlling a power supply to the driving unit 40 during a hydrating operation.

The drainage unit 50 includes a pump 51 having an inlet portion connected to a bottom of the fixed drum 20 via a connecting hose 52, and a drain hose 53 connected with an outlet portion of the pump 51 and extended outside of the housing 10. Therefore, the washing water pumped by the pump 51 is discharged outside the drum washing machine through the drain hose 53 during the draining operation. An activation process of the pump 51 is also preprogrammed in the control unit of the drum washing machine.

Figure 3:
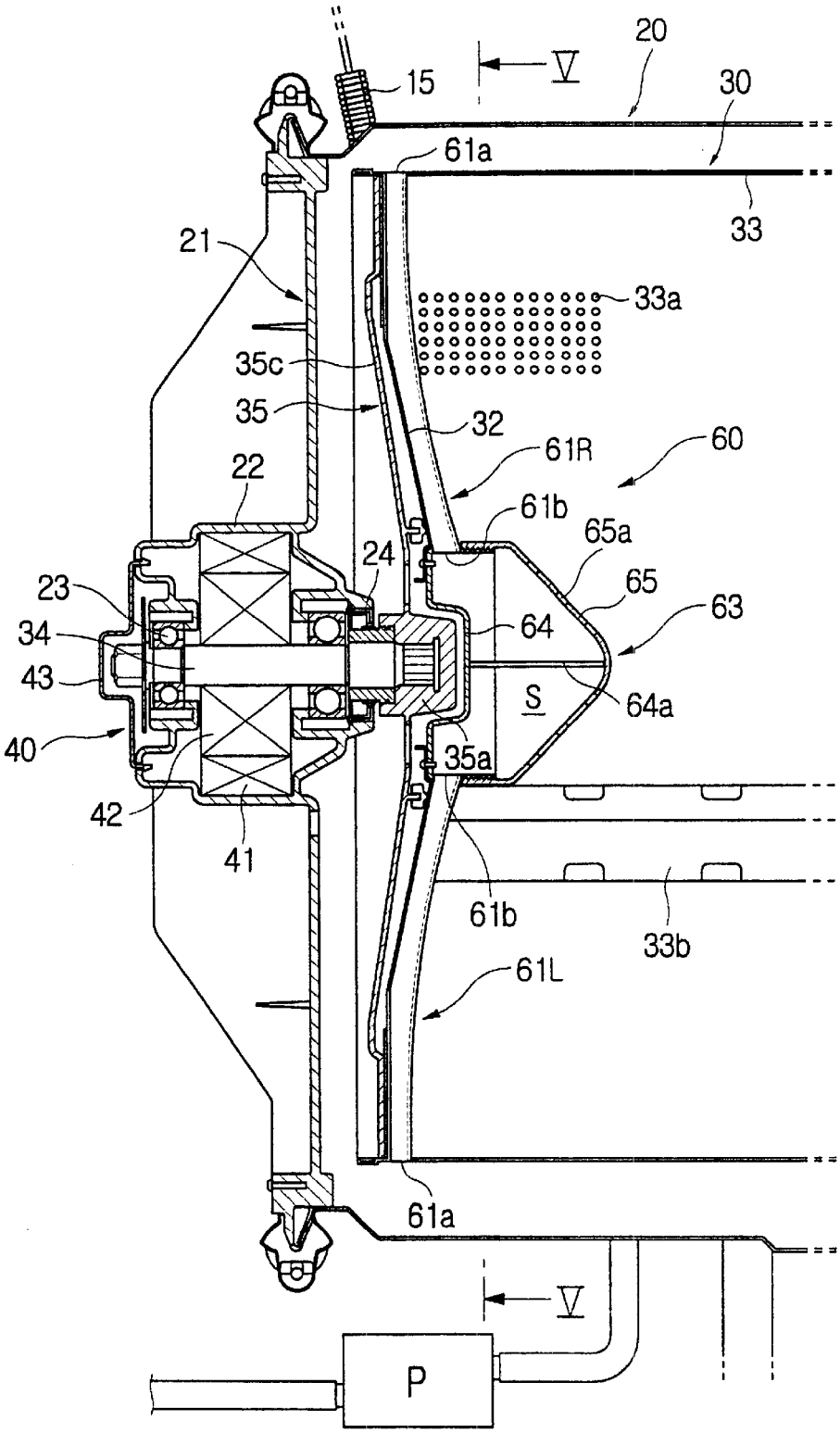
FIG. 3 is a partial cross-sectional view showing a rear part of the drum washing machine of FIG. 2.
Figure 4:
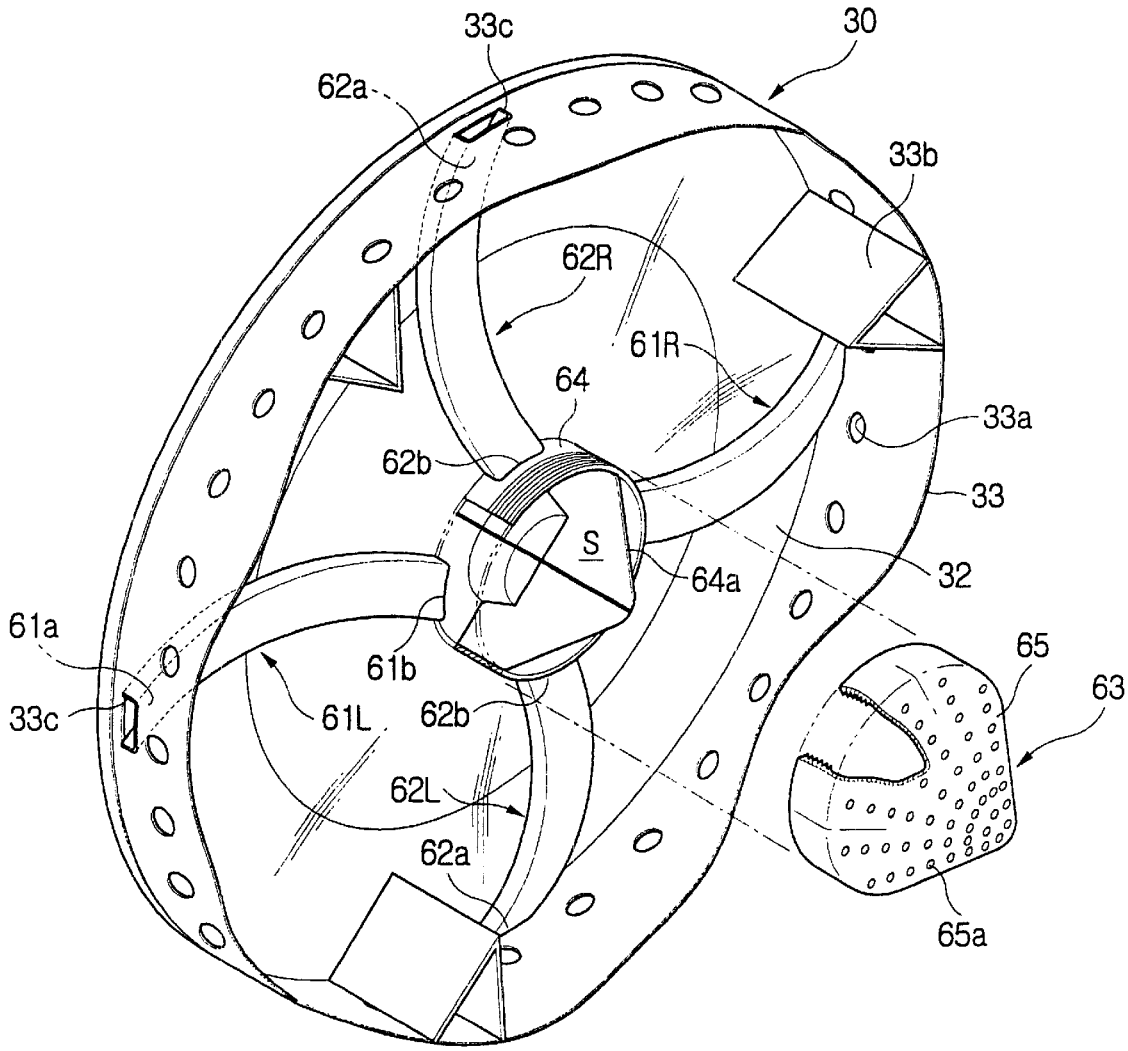
FIG. 4 is a perspective view showing an interior structure of a rotatable drum of FIG. 3.

The washing water circulation unit 60 includes a drawing unit drawing the washing water contained in the fixed drum 20 to a center portion of the rotatable rear panel 32 of the rotatable drum 30 by the turning force of the rotatable drum 30, and a spraying unit 63 spraying the washing water supplied by the drawing unit into the rotatable drum 30. These units will now be described in more detail with reference to FIGS. 3 and 4.

The drawing unit is provided at an inner side of the rotatable rear panel 32 of the rotatable drum 30 and rotated therewith. The drawing unit includes first water-guiding ducts 61L and 61R each of which is connected at one end 61*b* to the spraying unit and curved with respect to a radial line of the center portion of the rotatable rear panel 32, and each of which is extended to a peripheral portion of the rotatable rear panel 32 and terminated in another end 61*a*, and second water-guiding ducts 62L and 62R each of which is connected at one end 62*b* to the spraying unit and curved in an opposite direction to the first water-guiding ducts 61L and 61R and each of which is extended to a peripheral portion of the rotatable rear panel 32 and terminated in another end 62*a*.

The another end 61*a* of the first water-guiding ducts 61L and 61R and the another end 62*a* of the second water-guiding ducts 62L and 62R communicate with the fixed drum 20 through side openings 33*c* formed at the side panel 33 of the rotatable drum 30. Accordingly, when the rotatable drum 30 is rotated, the another ends 61*a* and 62*a* (referred to as an inlet hereinafter) of the first water-guiding ducts 61L and 61R and the second water-guiding ducts 62L and 62R serve as the inlet allowing the washing water to be sucked in, and the one ends 61*b* and 62*b* (referred to as an outlet hereinafter) of the first water-guiding ducts 61L and 61R and the second water-guiding ducts 62L and 62R serve as the outlet allowing the washing water to be discharged into the spraying unit 63.

The first water-guiding ducts 61L and 61R are positioned to form a pair symmetrical to each other about the spraying unit 63, and the second water-guiding ducts 62L and 62R are also positioned to form a pair symmetrical to each other about the spraying unit 63. This arrangement of the first and second water-guiding ducts 61L, 61R, 62L, and 62R is intended to raise or draw a larger amount of the washing water from the fixed drum 20 during repeated forward and reverse rotations of the rotatable drum 30.

The spraying unit 63 sprays the washing water supplied through the first water-guiding ducts 61L and 61R and the second water-guiding ducts 62L and 62R into the rotatable drum 30, and is disposed at the center portion of the rotatable rear panel 32 of the rotatable drum 30. The spraying unit 63 includes a base member 64 mounted on the center portion of the rotatable rear panel 32 of the rotatable drum 30 and connected to the outlets 61*b* and 62*b* of the first water-guiding ducts 61L and 61R and the second water-guiding ducts 62L and 62R, and a nozzle cap 65 threadedly coupled to the base member 64 to cover the base member 64 and formed with a plurality of nozzles 65*a*. The base member 64 is also provided with a crossed partition 64*a* dividing an interior space within the nozzle cap 65 into four compartments "S". The divided compartments "S" communicate with respective outlets 61*b* and 62*b* of the first water-guiding ducts 61L and 61R and the second water-guiding ducts 62L and 62R.

With these compartments "S", it is possible to prevent the outlets 61*b* and 62*b* of the first water-guiding ducts 61L and 61R and the second water-guiding ducts 62L and 62R from being connected to each other in the spraying unit 63. Therefore, the washing water sucked upwards through the first water-guiding ducts 61L and 61R and the second water-guiding ducts 62L and 62R is sprayed into the rotatable drum 30 only through the nozzles 65*a*. A circulation cycle of the washing water and functions and effects of the drum washing machine will be described in detail hereinafter.

After the laundry is first put into the rotatable drum 30 through the opened door 12, the drum washing machine operates by manipulation of a control panel (not shown). By the operation of the drum washing machine, the fixed drum 20 is supplied therein with an adequate amount of the detergent from the detergent container 13 and an adequate amount of the washing water depending on the amount of the laundry to be washed.

When the washing and rinsing operations are initiated after completion of the supply of the washing water, the rotor 42 of the driving unit 40 is repeatedly rotated in the forward and reverse directions together with the rotating shaft 34 and the rotatable drum 30. The repeated forward and reverse rotations of the rotatable drum 30 cause the laundry to be rolled and lifted up by the lifter 33*b* and then to fall down, thereby generating a washing effect on the laundry.

In the washing and rinsing operations, a portion of the washing water collected in the fixed drum 20 is partly drawn upwards to the center portion of the rotatable rear panel 32 of the rotatable drum 30 via the first water-guiding ducts 61L and 61R and the second water-guiding ducts 62L and 62R, and then sprayed into the rotatable drum 30 through the nozzle 65 of the spray unit 63. The washing water is repeatedly circulated in this way.

Figure 5:
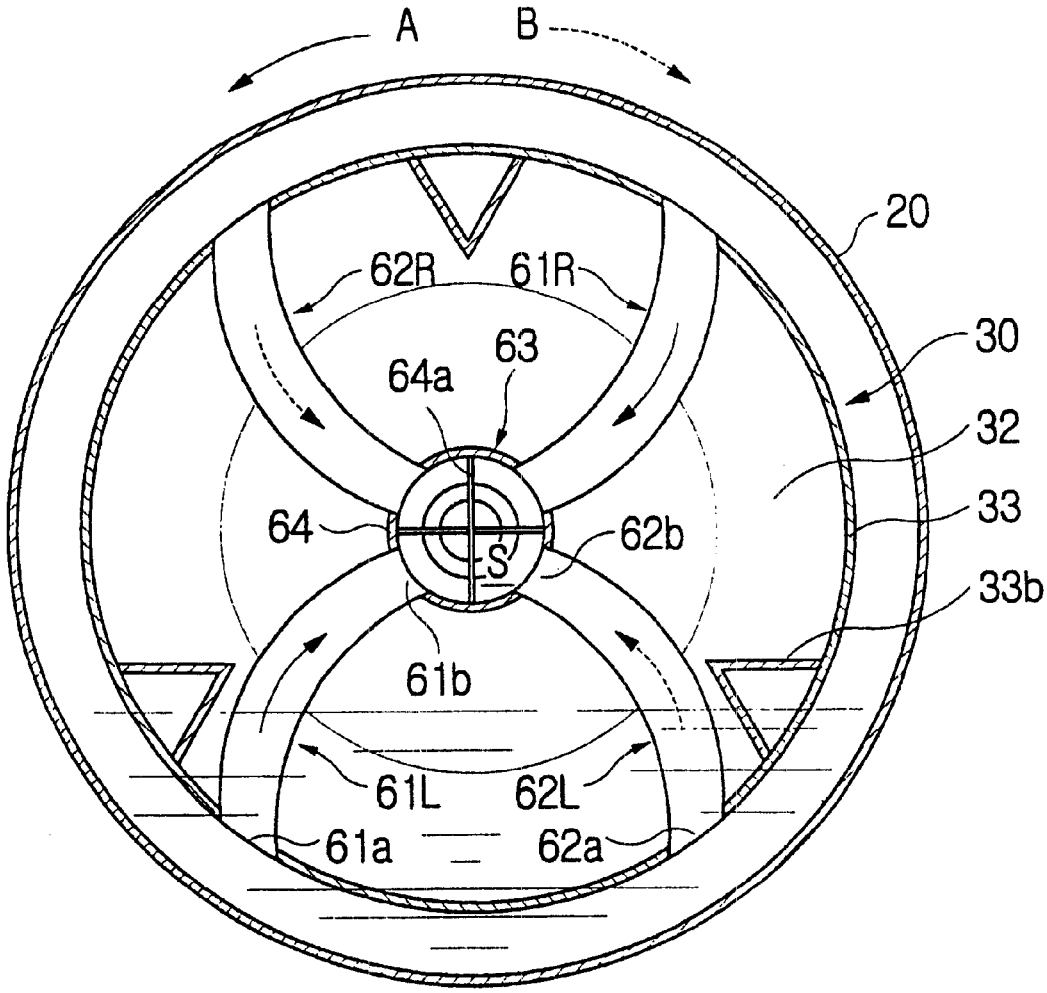
FIG. 5 is a cross-sectional view taken along line V—V of FIG. 3.

More specifically, as shown in FIG. 5, when the rotatable drum 30 is rotated in the forward direction of an arrow "A", the washing water is introduced into the inlet 61*a* of the first water-guiding ducts 61L and 61R and then raised along or drawn through the first water-guiding ducts 61L and 61R in a direction of a solid arrow. Then, the drawn washing water is introduced into the spraying unit 63 through the outlet 61*b*, and the washing water introduced into the spraying unit 63 is sprayed into the rotatable drum 30 through the nozzles 65*a*. On the other hand, when the rotatable drum 30 is rotated in the reverse direction (of arrow "B"), the washing water is introduced into the inlet 62*a* of the second water-guiding ducts 62L and 62R and then drawn through the second water-guiding ducts 62L and 62R in a direction of a dotted arrow. Then, the washing water is introduced into the spraying unit 63 through the outlet 61*b*, and the washing water introduced into the spraying unit 63 is sprayed into the rotatable drum 30 through the nozzles 65*a*.

At this point, since the outlets 61*b* and 62*b* of the first water-guiding ducts 61L and 61R and the second water-guiding ducts 62L and 62R are isolated from each other in an interior space of the spraying unit 63 by the crossed partition 64*a*, the washing Water raised along or drawn through the first water-guiding ducts 61L and 61R and the second water-guiding ducts 62L and 62R by the forward and reverse rotations of the rotatable drum 30 is sprayed into the rotatable drum 30 only through the nozzles 65*a* of the spraying unit 63.

Therefore, the laundry in the rotatable drum 30 is directly impinged with the washing water sprayed from the nozzles 65*a* of the spray unit 63 in an initial stage of the washing operation, and thus becomes immediately wet with the washing water. Furthermore, since the detergent which has sunk to a bottom of the fixed drum 20 is circulated together with the washing water, the detergent completely dissolves in a short period of time In addition, since the washing water is circulated by the turning force of the rotatable drum 30 without activating the pump 51 during the washing operation, the power consumption required to circulate the washing water can be reduced.

Moreover, foreign substances contained in the washing water can be collected in the spraying unit 63 while the washing water is repeatedly circulated through the first and second water-guiding ducts 61L, 61R, 62L and 62R and the spraying unit 63. The foreign substances collected in the spraying unit 63 can be easily removed by separation of the nozzle cap 65.

As described above, the present invention provides a drum washing machine which is adapted to draw the washing water contained in the fixed drum by the turning force of the rotatable drum upward to the center portion of the rotatable rear panel of the rotatable drum and spray the drawn washing water into the rotatable drum through the nozzle. Therefore, the, circulation of the washing water accelerates dissolution of the detergent, and the laundry is directly impinged with the washing water sprayed from the nozzle, thereby shortening a time amount required to wet the laundry. As a result, the washing efficiency of the drum washing machine can be remarkably enhanced using only a small quantity of the washing water.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A drum washing machine comprising:

a housing;

a fixed drum disposed in the housing and containing washing water;

a rotatable drum having a rear panel and rotatably disposed in the fixed drum; and a circulation unit supplying the washing water contained in the fixed drum to the rotatable drum, the circulation unit comprising:

a drawing unit drawing the washing water upwards toward a center portion of the rear panel of the rotatable drum by a turning force of the rotatable drum; and a spraying unit formed on the center portion of the rear panel to spray the washing water into the rotatable drum;

wherein the drawing unit is formed on the rear panel of the rotatable drum and provided with a curved water-guiding duct connected between the spraying unit and a periphery of the rear panel to communicate with the fixed drum.

2. The drum washing machine of claim 1, wherein the curved water-guiding duct includes first water-guiding ducts drawing the washing water during a first rotation in a first rotational direction of the rotatable drum, and second water-guiding ducts drawing the washing water during a second rotation in a second rotational direction of the rotatable drum.

3. The drum washing machine of claim 2, wherein the first water-guiding ducts are disposed to form a pair symmetrical to each other and around the spraying unit, and the second water-guiding ducts are disposed to form a pair symmetrical to each other and around the spraying unit.

4. The drum washing machine of claim 2, wherein the spraying unit is disposed at the center portion of the rear panel of the rotatable drum and provided with a nozzle to allow the washing water introduced into the spray unit through the first and second water-guiding ducts to be sprayed therethrough.

5. The drum washing machine of claim 1, wherein the spraying unit is disposed at the center portion of the rear panel of the rotatable drum and provided with a nozzle to allow the washing water drawn by the drawing unit to be sprayed therethrough.

6. The drum washing machine of claim 4, further comprising a partition formed in the spraying unit, wherein an interior space of the spraying unit is divided into a plurality of subspaces each communicating with a corresponding one of the first and second water-guiding ducts.

7. A washing machine, comprising:

a fixed drum containing washing water;

a rotatable drum rotatably disposed within the fixed drum, having a cylindrical panel and a rear panel attached to one open end of the cylindrical panel; and a washing water circulating unit formed on the rear panel of the rotatable drum, having a duct formed between a peripheral portion of the rear panel and a center portion of the rear panel, drawing the washing water from the fixed drum toward the center portion of the rear panel by a turning force generated when the rotatable drum rotates, and spraying the drawn washing water into an inside of the cylindrical panel of the rotatable drum.

8. The washing machine of claim 7, wherein the duct communicates with the fixed drum and the inside of the cylindrical panel of the rotatable drum.

9. The washing machine of claim 7, wherein the washing water circulating unit comprises:

a spraying unit formed on the central portion of the rear panel to communicate with the duct, protruding toward an inside of the cylindrical panel of the rotatable drum, and spraying the washing water into the inside of the cylindrical panel of the rotatable drum.

10. The washing machine of claim 7, wherein the washing water circulating unit comprises:

an inlet portion formed in one end of the duct and disposed in the peripheral portion of the rear panel to communicate with an outside of the cylindrical panel; and an outlet portion formed in another end of the duct and disposed in the center portion of the rear panel to communicate with the inside of the cylindrical panel.

11. The washing machine of claim 10, further comprising a spraying unit connected to the outlet portion and disposed within the cylindrical panel, wherein the washing water drawn through the duct is sprayed into the cylindrical panel of the rotatable drum through of the spraying unit.

12. The washing machine of claim 10, wherein the duct is curved from the peripheral portion to the central portion.

13. The washing machine of claim 10, wherein the cylindrical panel of the rotatable drum rotates about an axial line passing through the center portion of the rear panel.

14. The washing machine of claim 10, wherein the inlet portion of the duct is coupled to the cylindrical panel to draw the washing water disposed between the cylindrical panel and the fixed drum.

15. The washing machine of claim 14, wherein the inlet portion of the duct has an acute angle with a radial line perpendicular to the axial line.

16. The washing machine of claim 7, wherein the duct comprises a first water-guiding duct drawing the washing water during a first rotation of the rotatable drum in a first rotational direction and a second water-guiding duct drawing the washing water during a second rotation of the rotatable drum in a second rotational direction.

17. The washing machine of claim 7, wherein the duct comprises a first water-guiding duct and a second water-guiding duct forming a pair with the first water-guiding duct, the pair disposed at opposite sides of the central portion of the rear panel.

18. The washing machine of claim 17, wherein the washing water circulating unit comprises a spraying unit disposed in the central portion to communicate with the first and second water-guiding ducts, wherein the spraying unit sprays the washing water drawn through one of the first and second water-guiding ducts.

19. The washing machine of claim 17, wherein the washing water circulating unit comprises a spraying unit disposed in the central portion to communicate with the first and second water-guiding ducts, the spraying unit having a partition dividing an inside of the spraying unit into a plurality of compartments each exclusively communicating with a corresponding one of the first and second water-guiding ducts.

20. The washing machine of claim 19, wherein the spraying unit comprises a plurality of nozzles formed on each compartment of the spraying unit to spray the washing water drawn through the corresponding one of the first and second water-guiding ducts.

21. The washing machine of claim 7, wherein the washing water circulating unit comprises a spraying unit disposed within the center portion of the rear panel and an inside of the cylindrical panel of the rotatable drum and coupled to the duct to receive the washing water.

22. A washing machine, comprising:

affixed drum containing washing water;

a rotatable drum disposed within the fixed drum, having a cylindrical panel, side openings formed on respective opposite ends of the cylindrical panel, and a rear panel attached to one of the side openings, and rotating about an axial line passing through each center portion of the cylindrical panel, the side openings, and the rear panel;

a duct unit formed on the rear panel and between a peripheral portion of the rear panel and the center portion of the rear panel, drawing the washing water toward the center portion of the rear panel when the rotatable drum rotates; and a spraying unit formed in the center portion of the rear panel to communicate with the duct unit, spraying the washing water drawn from the fixed drum through the duct unit into the inside of the cylindrical panel of the rotatable drum.

23. The washing machine of claim 22, wherein the duct unit is disposed on a plane perpendicular to the axial line.

24. The washing machine of claim 22, wherein the duct unit is oblique at an angle with respect to a radial line perpendicular to the axial line.

25. The washing machine of claim 22, wherein the duct unit comprises:

a duct formed on the rear panel;

an inlet portion disposed in the peripheral portion of the rear panel to be coupled between the duct and the cylindrical panel to communicate with the fixed drum; and an outlet portion coupled between another end of the duct and the spraying unit.

26. The washing machine of claim 25, wherein the duct is curved between the inlet portion and the outlet portion.

27. The washing machine of claim 25, wherein the inlet is oblique at an angle with respect to a radial line perpendicular to the axial line.

28. The washing machine of claim 25, wherein the outlet is oblique at an angle with respect to a radial line perpendicular to the axial line.

29. The washing machine of claim 22, wherein the duct unit protrudes from a surface of the rear panel toward an inside of the cylindrical panel of the rotatable drum.

30. The washing machine of claim 22, further comprising an opening formed on the cylindrical panel and communicating with the duct unit, wherein the duct unit draws the washing water contained in the fixed drum through the opening when the rotatable drum rotates.

31. The washing machine of claim 22, wherein the duct unit comprises:

first water-guiding ducts each having a first outlet coupled to the spraying unit and a first inlet extended to the peripheral portion of the rear panel; and second water-guiding ducts each having a second outlet connected to the spraying unit and a second inlet extended to the peripheral portion of the rear panel.

32. The washing machine of claim 31, further comprising openings formed on the cylindrical panel and coupled to corresponding one of the first inlets and the second inlets, wherein the washing water is drawn through either the first inlets or the second inlets.

33. The washing machine of claim 31, wherein the first and second water-guiding ducts are disposed on the rear panel to be spaced-apart at predetermined intervals around the spraying unit.

34. The washing machine of claim 33, wherein one of the first and second water-guiding ducts is disposed between the second water-guiding ducts.

35. The washing machine of claim 33, wherein the first water-guiding ducts draw the washing water from the fixed drum toward the spraying unit when the rotatable drum rotates in a first direction while the second water-guiding ducts draws the washing water from the fixed drum toward the spraying unit when the rotatable drum rotates in a second direction opposite to the first direction.

36. The washing machine of claim 31, wherein the spraying unit comprises a base member mounted on the center portion of the rear panel and connected with the first and second outlets of the first and second water-guiding ducts, and a nozzle cap coupled to the base member to cover the base member and formed with a plurality of nozzles.

37. The washing machine of claim 36, wherein the base member comprises a partition dividing an interior space into four compartments each connected to the corresponding one of the first and second outlets of the first and second water-guiding ducts.

38. The washing machine of claim 36, wherein each of the compartments exclusively receives the washing water drawn through only a corresponding one of the of the first and second water-guiding ducts.

39. The washing machine of claim 31, wherein the first inlets of the first water-guiding ducts are oblique at a positive angle with respect to a radial line perpendicular to the axial line while the second inlets of the second water-guiding ducts are oblique at a negative angle with respect to the radial line.

40. The washing machine of claim 31, wherein the washing water is drawn toward the spraying unit through the first inlets of the first water-guiding ducts when the rotatable drum rotates in a first direction while the washing water is drawn from the fixed drum toward the spraying unit through the second inlets of the second water-guiding ducts when the rotatable drum rotates in a second direction.

41. The washing machine of claim 31, wherein the first and second outlets of the first and second water-guiding ducts are oblique at an angle with respect to a radial line perpendicular to the axial line.

42. The washing machine of claim 24, wherein the washing water is automatically drawn from the fixed drum through the duct unit when the rotatable drum rotates in washing and rinsing operations.

* * * * *

UNITED STATES PATENT AND TRADEMARK OFFICE

CERTIFICATE OF CORRECTION

PATENT NO. : 6,612,138 B2
DATED : September 2, 2003
INVENTOR(S) : Doo-Young Ryu et al.

It is certified that error appears in the above-identified patent and that said Letters Patent is hereby corrected as shown below:

Column 9,
Line 34, change “affixed” to -- a fixed --.

Signed and Sealed this

Ninth Day of December, 2003

JAMES E. ROGAN
*Director of the United States Patent and Trademark Office*